US006385905B1

(12) United States Patent
Weder

(10) Patent No.: US 6,385,905 B1
(45) Date of Patent: May 14, 2002

(54) POT COVER HAVING AN ELASTIC PORTION

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/651,567

(22) Filed: Aug. 29, 2000

Related U.S. Application Data

(63) Continuation-in-part of application No. 09/401,771, filed on Sep. 22, 1999, now Pat. No. 6,230,441, which is a continuation of application No. 08/606,957, filed on Feb. 26, 1996, now abandoned.

(51) Int. Cl.[7] ..... A47G 7/08

(52) U.S. Cl. ..... 47/72

(58) Field of Search ..... 47/72; 206/423

(56) References Cited

U.S. PATENT DOCUMENTS

| | | | | |
|---|---|---|---|---|
| 524,219 | A | 8/1894 | Schmidt | |
| 732,889 | A | 7/1903 | Paver | |
| 950,785 | A | 3/1910 | Pene | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | 229/87 |
| 1,863,216 | A | 6/1932 | Wordingham | |
| 1,978,631 | A | 10/1934 | Herrlinger | 91/68 |
| 2,048,123 | A | 7/1936 | Howard | 229/87 |
| RE21,065 | E | 5/1939 | Copeman | 93/2 |
| 2,170,147 | A | 8/1939 | Lane | 206/56 |
| 2,200,111 | A | 5/1940 | Bensel | 229/1.5 |
| 2,278,673 | A | 4/1942 | Savada et al. | 154/43 |
| 2,302,259 | A | 11/1942 | Rothfuss | 41/10 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,411,328 | A | 11/1946 | MacNab | 33/12 |
| 2,510,120 | A | 6/1950 | Leander | 117/122 |
| 2,529,060 | A | 11/1950 | Trillich | 117/68.5 |
| 2,621,142 | A | 12/1952 | Wetherell | 154/117 |
| 2,648,487 | A | 8/1953 | Linda | 229/55 |
| 2,688,354 | A | 9/1954 | Berger | 150/28 |
| 2,774,187 | A | 12/1956 | Smithers | 47/41 |
| 2,822,287 | A | 2/1958 | Avery | 117/14 |
| 2,846,060 | A | 8/1958 | Yount | 206/58 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |

(List continued on next page.)

OTHER PUBLICATIONS

Speed Cover Brochure, "The Simple Solution For Those Peak Volume Periods", Highland Supply Corporation, ©1989.

"Speed Sheets and Speed Rolls" Brochure, Highland Supply Corporation, ©1990.

"Color Them Happy with Highlander Products" ©1992.

"Costa Keeps the Christmas Spirit", Supermarket Floral, Sep. 15, 1992.

(List continued on next page.)

*Primary Examiner*—Peter M. Poon
*Assistant Examiner*—Jeffrey L. Gellner
(74) *Attorney, Agent, or Firm*—Dunlap, Codding & Rogers, P.C.

(57) ABSTRACT

A tubular sleeve for covering a floral container such as a flower pot, the tubular sleeve having a lower portion constructed from an elastic material which can be stretched about the bottom of a floral container, to secure the sleeve about the floral container.

18 Claims, 3 Drawing Sheets

U.S. PATENT DOCUMENTS

| | | | | | |
|---|---|---|---|---|---|
| 2,850,842 | A | | 9/1958 | Eubank, Jr. | 47/58 |
| 2,883,262 | A | | 4/1959 | Borin | 21/56 |
| 2,989,828 | A | | 6/1961 | Warp | 53/390 |
| 3,022,605 | A | | 2/1962 | Reynolds | 47/58 |
| 3,080,680 | A | | 3/1963 | Reynolds | 47/37 |
| 3,094,810 | A | | 6/1963 | Kalpin | 47/37 |
| 3,121,647 | A | | 2/1964 | Harris et al. | 118/202 |
| 3,130,113 | A | | 4/1964 | Silman | 161/97 |
| 3,271,922 | A | | 9/1966 | Wallerstein et al. | 53/3 |
| 3,322,325 | A | | 5/1967 | Bush | 229/62 |
| 3,376,666 | A | | 4/1968 | Leonard | 47/41 |
| 3,380,646 | A | | 4/1968 | Doyen et al. | 229/57 |
| 3,431,706 | A | | 3/1969 | Stuck | 53/390 |
| 3,508,372 | A | | 4/1970 | Wallerstein et al. | 53/3 |
| 3,510,054 | A | | 5/1970 | Sanni et al. | 229/66 |
| 3,512,700 | A | | 5/1970 | Evans et al. | 229/53 |
| 3,552,059 | A | | 1/1971 | Moore | 47/41.12 |
| 3,554,434 | A | | 1/1971 | Anderson | 229/55 |
| 3,556,389 | A | | 1/1971 | Gregoire | 229/53 |
| 3,557,516 | A | | 1/1971 | Brandt | 53/14 |
| 3,620,366 | A | | 11/1971 | Parkinson | 206/59 |
| 3,681,105 | A | | 8/1972 | Milutin | 117/15 |
| 3,767,104 | A | | 10/1973 | Bachman et al. | 229/7 |
| 3,793,799 | A | | 2/1974 | Howe | 53/32 |
| 3,869,828 | A | | 3/1975 | Matsumoto | 47/34.11 |
| 3,888,443 | A | | 6/1975 | Flanigen | 248/152 |
| 3,962,503 | A | | 6/1976 | Crawford | 428/40 |
| 4,043,077 | A | | 8/1977 | Stonehocker | 47/66 |
| 4,054,697 | A | | 10/1977 | Reed et al. | 428/40 |
| 4,091,925 | A | | 5/1978 | Griffo et al. | 206/423 |
| 4,113,100 | A | | 9/1978 | Soja et al. | 206/602 |
| 4,118,890 | A | | 10/1978 | Shore | 47/28 |
| 4,189,868 | A | | 2/1980 | Tymchuck et al. | 47/84 |
| 4,216,620 | A | | 8/1980 | Weder et al. | 47/72 |
| 4,248,347 | A | | 2/1981 | Trimbee | 206/423 |
| D259,333 | S | | 5/1981 | Charbonneau | D9/306 |
| 4,265,049 | A | | 5/1981 | Gorewitz | 47/26 |
| 4,280,314 | A | | 7/1981 | Stuck | 53/241 |
| 4,297,811 | A | | 11/1981 | Weder | 47/72 |
| 4,333,267 | A | * | 6/1982 | Witte | 47/72 |
| 4,347,686 | A | | 9/1982 | Wood | 47/73 |
| 4,380,564 | A | | 4/1983 | Cancio et al. | 428/167 |
| 4,400,910 | A | | 8/1983 | Koudstall et al. | 47/84 |
| 4,413,725 | A | | 11/1983 | Bruno et al. | 206/45.33 |
| D279,279 | S | | 6/1985 | Wagner | D11/143 |
| 4,546,875 | A | | 10/1985 | Zweber | 206/0.82 |
| 4,621,733 | A | | 11/1986 | Harris | 206/423 |
| 4,640,079 | A | | 2/1987 | Stuck | 53/390 |
| 4,717,262 | A | | 1/1988 | Roen et al. | 383/120 |
| 4,733,521 | A | | 3/1988 | Weder et al. | 53/580 |
| 4,765,464 | A | | 8/1988 | Ristvedt | 206/0.82 |
| 4,771,573 | A | | 9/1988 | Stengel | 47/67 |
| 4,773,182 | A | | 9/1988 | Weder et al. | 47/72 |
| 4,801,014 | A | | 1/1989 | Meadows | 206/423 |
| 4,810,109 | A | | 3/1989 | Castel | 383/105 |
| 4,835,834 | A | | 6/1989 | Weder | 29/525 |
| D301,991 | S | | 7/1989 | Van Sant | D11/149 |
| 4,941,572 | A | | 7/1990 | Harris | 206/423 |
| 4,980,209 | A | | 12/1990 | Hill | 428/34.1 |
| 5,073,161 | A | | 12/1991 | Weder et al. | 493/154 |
| 5,074,675 | A | | 12/1991 | Osgood | 383/122 |
| 5,105,599 | A | | 4/1992 | Weder | 53/399 |
| 5,111,638 | A | | 5/1992 | Weder | 53/397 |
| 5,120,382 | A | | 6/1992 | Weder | 156/212 |
| 5,152,100 | A | | 10/1992 | Weder et al. | 47/72 |
| 5,181,364 | A | | 1/1993 | Weder | 53/397 |
| D335,105 | S | | 4/1993 | Ottenwalder et al. | D11/164 |
| 5,199,242 | A | | 4/1993 | Weder et al. | 53/397 |
| 5,205,108 | A | | 4/1993 | Weder et al. | 53/397 |
| 5,228,234 | A | | 7/1993 | de Klerk et al. | 47/41.01 |
| 5,235,782 | A | | 8/1993 | Landau | 47/72 |
| 5,239,775 | A | | 8/1993 | Landau | 47/72 |
| 5,249,407 | A | | 10/1993 | Stuck | 53/399 |
| 5,259,106 | A | | 11/1993 | Weder et al. | 29/469.5 |
| 5,307,606 | A | | 5/1994 | Weder | 53/410 |
| 5,315,785 | A | | 5/1994 | Avôt et al. | 47/72 |
| 5,350,240 | A | | 9/1994 | Billman et al. | 383/104 |
| 5,353,575 | A | | 10/1994 | Stepanek | 53/461 |
| 5,361,482 | A | | 11/1994 | Weder et al. | 29/469 |
| 5,388,695 | A | | 2/1995 | Gilbert | 206/423 |
| 5,428,939 | A | | 7/1995 | Weder et al. | 53/397 |
| 5,443,670 | A | | 8/1995 | Landau | 156/191 |
| 5,493,809 | A | | 2/1996 | Weder et al. | 47/72 |
| D368,025 | S | | 3/1996 | Sekerak et al. | D9/305 |
| 5,496,251 | A | | 3/1996 | Cheng | 493/224 |
| 5,496,252 | A | | 3/1996 | Gilbert | 493/224 |
| 5,526,932 | A | | 6/1996 | Weder | 206/423 |
| 5,572,849 | A | | 11/1996 | Weder et al. | 53/399 |
| 5,572,851 | A | | 11/1996 | Weder | 53/399 |
| 5,575,133 | A | | 11/1996 | Weder et al. | 53/397 |
| 5,617,703 | A | | 4/1997 | Weder | 53/413 |
| 5,624,320 | A | | 4/1997 | Martinez | 472/51 |
| 5,625,979 | A | | 5/1997 | Weder | 435/600 |
| 5,647,168 | A | | 7/1997 | Gilbert | 47/72 |
| 5,829,225 | A | | 11/1998 | Weder et al. | 53/397 |
| 5,896,698 | A | * | 4/1999 | Nurse | 47/72 X |
| 5,924,241 | A | * | 7/1999 | Hodge | 47/72 |
| 6,108,974 | A | * | 8/2000 | Herzog-Mesrobian et al. | 47/72 |
| 6,182,395 | B1 | * | 2/2001 | Weder et al. | 47/72 |
| 6,185,904 | B1 | * | 2/2001 | Weder et al. | 47/72 |
| 6,230,441 | B1 | * | 5/2001 | Weder et al. | 47/72 |

FOREIGN PATENT DOCUMENTS

| | | |
|---|---|---|
| DE | 345464 | 12/1921 |
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| EP | 0050990 | 5/1982 |
| EP | 0791543 | 8/1997 |
| FR | 2036163 | 12/1970 |
| FR | 2137325 | 12/1972 |
| FR | 2272914 | 12/1975 |
| FR | 2489126 | 3/1982 |
| FR | 2610604 | 8/1988 |
| FR | 2603159 | 3/1989 |
| FR | 2619698 | 3/1989 |
| FR | 1376047 | 9/1997 |
| GB | 5605 | of 1885 |
| GB | 1204647 | 9/1970 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 542958 | 2/1993 |
| NL | 8301709 | 12/1984 |
| NL | 1000658 | 1/1996 |
| WO | 9315979 | 8/1993 |

OTHER PUBLICATIONS

"Super Seller", Supermarket Floral, Sep. 15, 1992.

"Halloween", Link Magazine, Sep., 1992.

"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec., 1996, 2 pages.
"Derwent Abstract" of FR 2610604A. It is noted that the abstract is an incorrect English translation of the contents of the French patent. The French patent does not enable of disclose adhesively attaching the covering to the container. 1988.
"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

* cited by examiner

POT COVER HAVING AN ELASTIC PORTION

CROSS REFERENCE TO RELATED APPLICATIONS

The present application is a continuation-in-part of U.S. Ser. No. 09/401,771, filed Sep. 22,1999, entitled "Flat Cover Convertible to a Decorative Container," now U.S. Pat. No. 6,230,441, which is a continuation of U.S. Ser. No. 08/606, 957, filed Feb. 26, 1996, now abandoned, the specifications of each of which are hereby expressly incorporated by reference herein.

BACKGROUND

The present invention pertains to, but is not limited to, the field related to sleeves or covers used to cover floral containers such as pots, or to the field related to containers used to contain plants or floral groupings. U.S. Pat. No. 5,625,979 contains subject matter which may be related to that of the present invention and is hereby expressly incorporated herein by reference in its entirety.

DETAILED DESCRIPTION OF THE INVENTION

Figure 1:
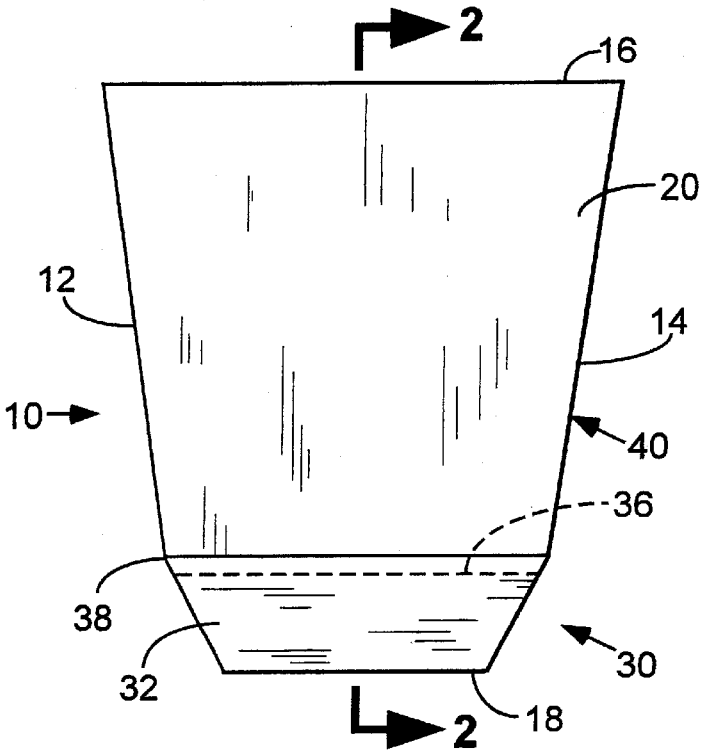
FIG. 1 is an elevational view of a floral sleeve constructed in accordance with the present invention.
Figure 2:
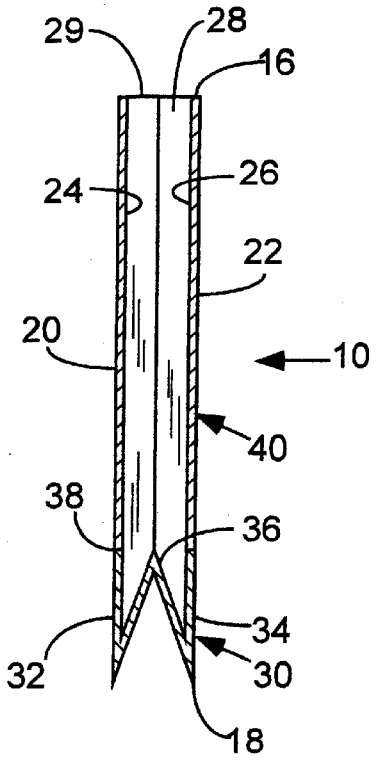
FIG. 2 is a cross-sectional view of the floral sleeve of FIG. 1 taken along line 2—2.
Figure 3:
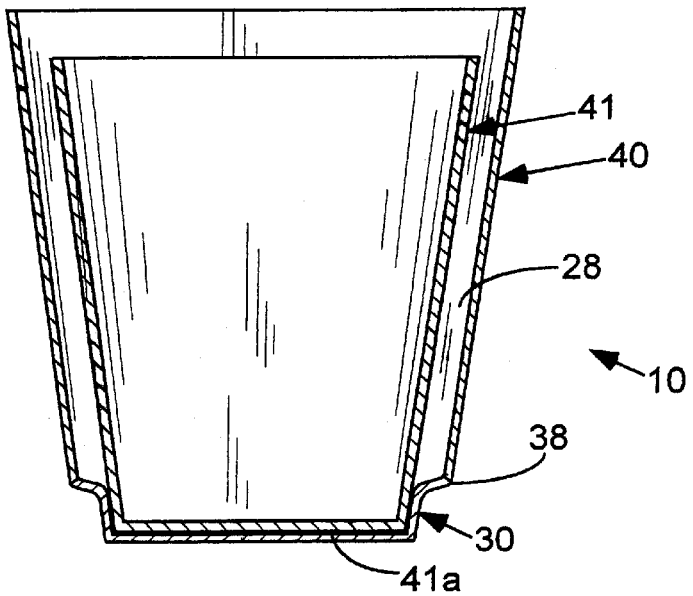
FIG. 3 is a cross-sectional view of the floral sleeve of FIG. 1 having a pot disposed therein.

Turning now to the drawings, shown in FIGS. 1 and 2 and designated therein by the general reference numeral 10, is a preformed floral sleeve (also referred to herein as a sleeve, floral sleeve, or cover) having a first side 12, a second side 14, an upper end 16, a lower end 18, a first panel 20, and a second panel 22. The floral sleeve 10 is initially formed in a flattened condition (FIG. 1) and is openable to have a generally tubular shape, preferably a tapered, inverted frustoconical shape as shown in FIG. 3. It will be appreciated, however, that the floral sleeve 10 may comprise variations on the aforementioned shapes or may comprise significantly altered shapes, such as square or rectangular, as long as the floral sleeve 10 functions in accordance with the present invention in the manner described herein. The floral sleeve 10 further comprises a first inner peripheral surface 24, a second inner peripheral surface 26, an inner retaining space 28 and an upper opening 29.

The floral sleeve 10 further comprises a lower portion 30 which forms an elastic portion which comprises a first elastic portion 32, a second elastic portion 34 and an elastic gusset portion 36. The first elastic portion 32 comprises a lower portion of the first panel 20 and the second elastic portion 34 comprises a lower portion of the second panel 22. Extending from an upper end 38 of the lower portion 30 to the upper end 16 of the floral sleeve 10 is an upper portion 40 which comprises that portion of the floral sleeve 10 which is not constructed of the same elastic material used to construct the lower portion 30. The upper portion 40 may be constructed of a material having a slight degree of elasticity, such as a polypropylene film; however, the upper portion 40 has significantly less elasticity than the lower portion 30. Preferably, the lower portion 30 is constructed from a material which has elastic properties such that when a floral container, such as a flower pot 41 having a bottom 41*a* is disposed within the inner retaining space 28 of the floral sleeve 10, the lower portion 30 expands to conform to the shape and bottom 41*a* of the flower pot 41, thereby "gripping" the flower pot 41 wherein the floral sleeve 10 is held about the flower pot 41. In particular, the elastic material used to construct the lower portion 30 may comprise a natural or synthetic rubber, or a rubberized material such as a latex-coated or impregnated fabric. Elastic polyurethanes, such as spandex or a fabric made with spandex, may also be used.

In one embodiment of the present invention, as shown in FIG. 3, the upper portion 40 may be oversized such that when the floral sleeve 10 is placed about the flower pot 41, the upper portion 40 is loose about the flower pot 41 and it is only by virtue of the gripping connection of the lower portion 30 to the flower pot 41 that the floral sleeve 10 can be secured about the flower pot 41 without an additional attaching element such as a string, tie, ribbon, wire, or adhesive or cohesive bonding material. Preferably, the lower portion 30 covers the entire bottom 41*a* of the flower pot 41. The lower portion 30 may be connected to the upper portion 40 via a butt seal, a seam seal, a lap seal, a fin seal, or any adhesion or sealing technique which is effective in connecting the elastic material of the lower portion 30 to the material from which the upper portion 40 is constructed.

Figure 4:
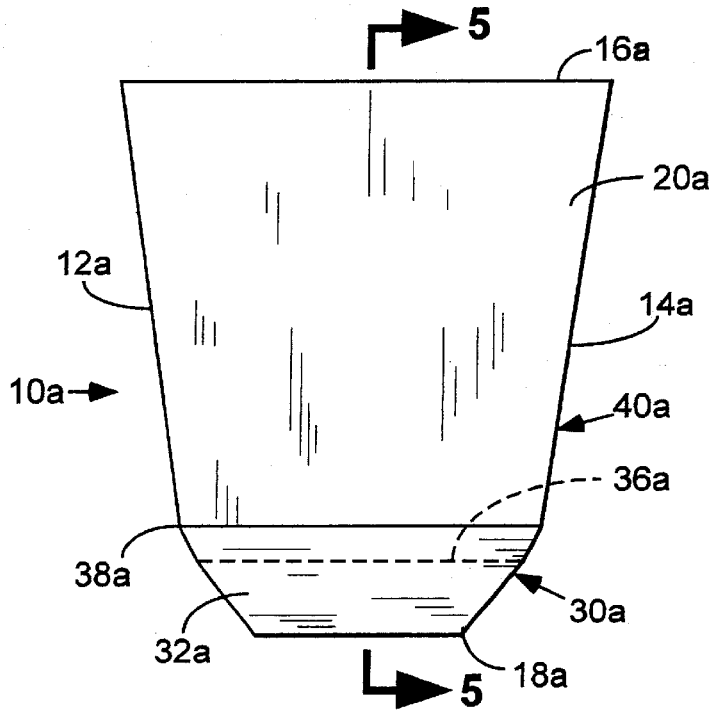
FIG. 4 is an elevational view of another floral sleeve constructed in accordance with the present invention.
Figure 5:
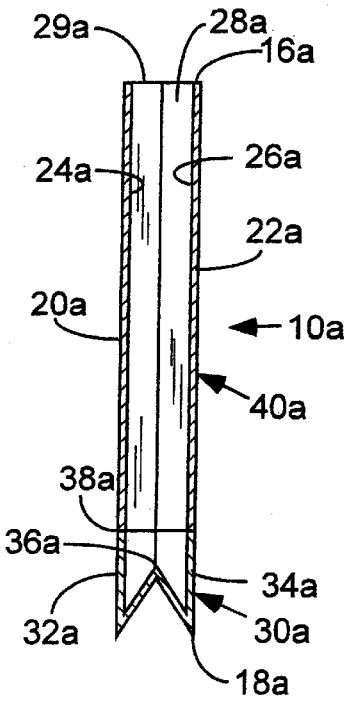
FIG. 5 is a cross-sectional view of the floral sleeve of FIG. 4 taken along line 5—5.

Shown in FIGS. 4 and 5 is another version of a sleeve of the present invention designated by the general reference numeral 10*a*. Sleeve 10*a* is similar to sleeve 10 described in detail above, and has a first side 12*a*, a second side 14*a*, an upper end 16*a*, a lower end 18*a*, a first panel 20*a*, a second panel 22*a*, a first inner peripheral surface 24*a*, a second inner peripheral surface 26*a*, an inner retaining space 28*a*, an upper opening 29*a*, a lower portion 30*a* having a first elastic side 32*a*, a second elastic side 34*a*, an elastic gusset portion 36*a*, an upper end 38*a* of the lower portion 30*a*, and an upper portion 40*a* which extends from the upper end 38*a* of the lower portion 30*a*. Sleeve 10*a* differs from sleeve 10 in that the upper end 38*a* of the lower portion 30*a* extends higher on the first panel 20*a* and on the second panel 22*a* than the upper end 38 extends on the first panel 20 and on the second panel 22 of sleeve 10. In this manner the lower portion 30*a* of the sleeve 10*a* can extend higher above the bottom 41*a* of the flower pot 41 when the sleeve 10*a* is disposed about the flower pot 41.

Figure 6:
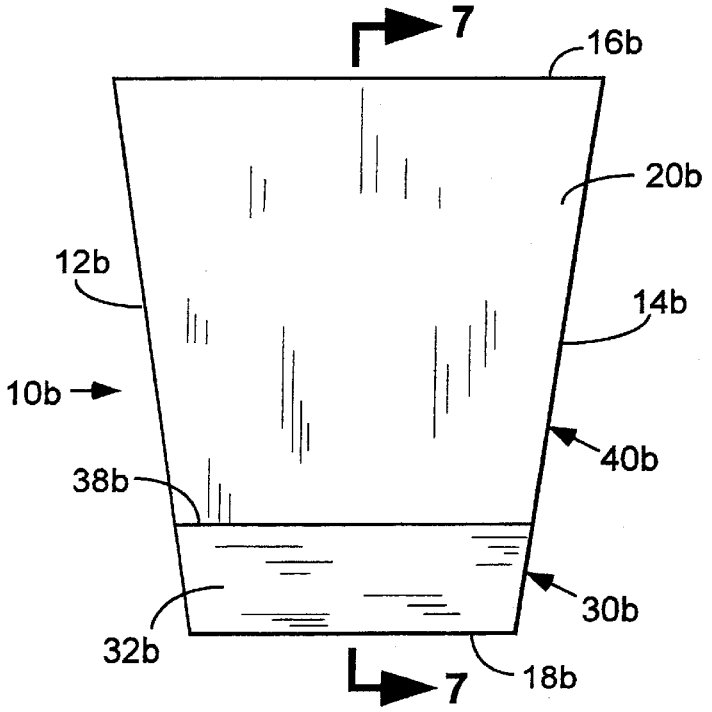
FIG. 6 is an elevational view of another floral sleeve constructed in accordance with the present invention.
Figure 7:
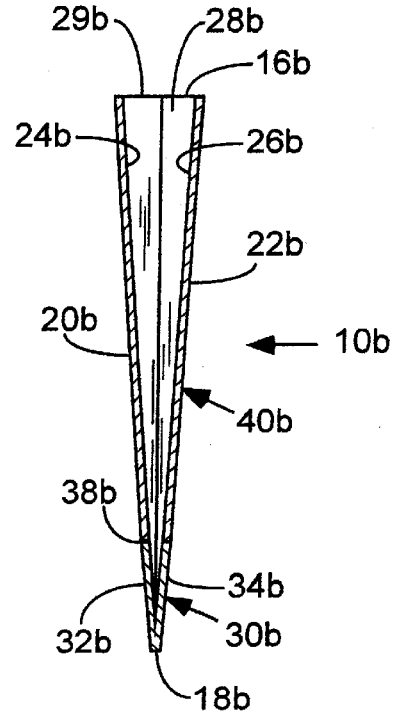
FIG. 7 is a cross-sectional view of the floral sleeve of FIG. 6 taken along line 7—7.

Shown in FIGS. 6 and 7 is another version of a sleeve of the present invention designated by the general reference numeral 10*b*. Sleeve 10*b* is similar to sleeves 10 or 10*a* described in detail above and has a first side 12*b*, a second side 14*b*, an upper end 16*b*, a lower end 18*b*, a first panel 20*b*, a second panel 22*b*, a first inner peripheral surface 24*b*, a second inner peripheral surface 26*b*, an inner retaining space 28*b*, an upper opening 29*b*, a lower portion 30*b* having a first elastic side 32*b*, a second elastic side 34*b*, an upper end 38*b* of the lower portion 30*b*, and an upper portion 40*b* which extends from the upper end 38*b* of the lower portion 30*b*.

Sleeve 10*b* differs from sleeves 10 and 10*a* in that the lower portion 30*b* does not comprise a gusset portion; instead, the lower end 18*b* has a straight seal thereacross.

Figure 8:
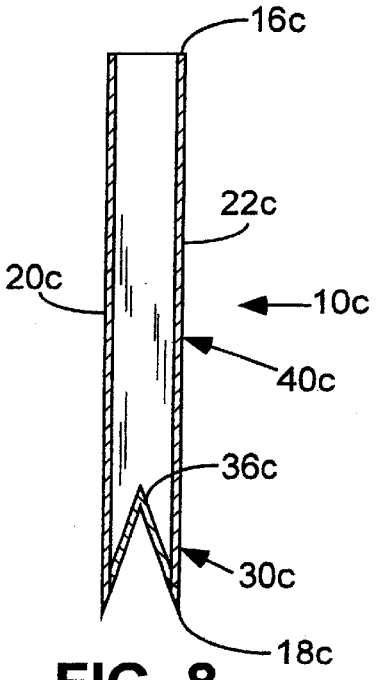
FIG. 8 is a cross-sectional view of yet another floral sleeve constructed in accordance with the present invention wherein the floral sleeve is in a substantially flattened state.

Shown in FIG. 8 is another version of a sleeve of the present invention designated by the general reference numeral 10*c*. Sleeve 10*c* has an upper end 16*c*, a lower end 18*c*, a first panel 20*c*, a second panel 22*c*, a lower portion 30*c*, a gusset portion 36*c* and an upper portion 40*c*. Sleeve 10*c* differs from sleeves 10 and 10*a* primarily in that the only portion of the lower portion 30*c* which comprises an elastic material is the gusset portion 36*c*. That is, first panel 20*c* and second panel 22*c* are substantially free of the elastic material used in the construction of the gusset portion 36*c* except for marginal portions at the lower end 18*c* where the gusset portion 36*c* is sealed to or otherwise attached to the first panel 20*c* and the second panel 22*c*.

Figure 9:
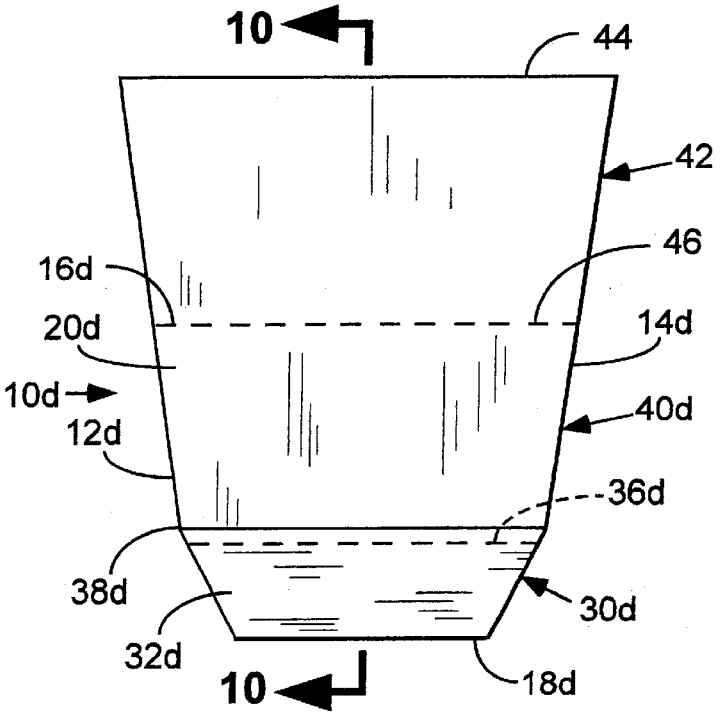
FIG. 9 is an elevational view of another floral sleeve constructed in accordance with the present invention.
Figure 10:
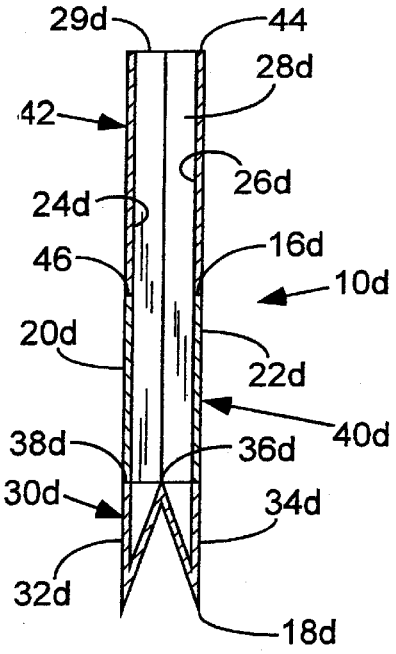
FIG. 10 is a cross-sectional view of the floral sleeve of FIG. 9 taken along line 10—10.

Shown in FIGS. 9 and 10 is another version of a sleeve of the present invention designated by the general reference numeral 10*d*. Sleeve 10*d* is similar to sleeve 10 described in detail herein and has a first side 12*d*, a second side 14*d*, an upper end 16*d*, a lower end 18*d*, a first panel 20*d*, a second panel 22*d*, a first inner peripheral surface 24*d*, a second inner peripheral surface 26*d*, an inner retaining space 28*d*, an upper opening 29*d*, a lower portion 30*d* having a first elastic portion 32*d*, a second elastic portion 34*d*, an elastic gusset portion 36*d*, an upper end 38*d* of the lower portion 30*d*, and an upper portion 40*d* which extends from the upper end 38*d* of the lower portion 30*d*. Sleeve 10*d* differs from sleeve 10 in that sleeve 10*d* further comprises a detachable extension 42 having an upper end 44. The extension 42 is attached to the upper end 16*d* of the upper portion 40*d* and is detachable from the upper portion 40*d* via a detaching element 46 which in a preferred embodiment is a line of perforations as indicated in FIG. 9. The detaching element 46 may be perforations, a zipper, a tear strip, or any other detaching mechanism known to a person of ordinary skill in the art. The extension 42 may be sized to surround and encompass a floral grouping disposed in and extending from a flower pot for the purpose of protecting the floral grouping or may extend from the upper portion 40*d* only a distance sufficient to enable the extension 46 to be used as a support member to support the sleeve 10*d* from a support assembly such as a wicket, staple, or other support assembly known to a person of ordinary skill in the art.

Figure 11:
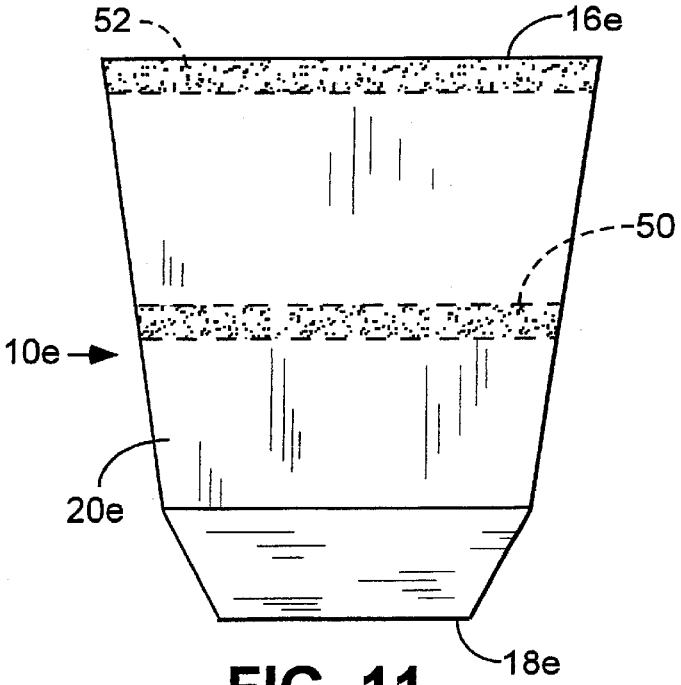
FIG. 11 is an elevational view of another floral sleeve constructed in accordance with the present invention.

FIG. 11 shows a sleeve designated by the general reference number 10*e* which is similar to sleeve 10 and having an upper end 16*e*, a lower end 18*e*, a first panel 20*e* and a second panel (not shown) and having an inner surface (not shown). Sleeve 10*e* has a first bonding material 50 disposed on a portion of the inner surface thereof and a second bonding material 52 disposed on a portion of the inner surface near the upper end 16*e*.

The first bonding material 50 may be used to assist in connecting or securing the sleeve 10*e* to a flower pot having a floral grouping therein when such a flower pot is disposed within the sleeve 10*e*. The second bonding material 52 may be used to assist in closing or sealing the upper end 16*e* of the sleeve 10*e* after the flower pot 41 has been disposed therein, for example, in the manner shown in U.S. Pat. No. 5,493,809, which is hereby incorporated by reference herein in its entirety. Each of sleeves 10–10*d* may be modified to have a bonding material disposed thereon in a similar manner.

It will be understood that the bonding material 50 or 52, when used, may be disposed as a strip or block on a surface of the sleeve 10*e*. The bonding material 50 or 52 may be covered by a cover or release strip (not shown) which can be removed prior to the use of the sleeve, pot or pot cover.

In yet another embodiment of the present invention, a sheet of material (not shown) could be formed about a flower pot before the floral sleeves 10–10*e* are placed about the flower pot, with the floral sleeves 10–10*e* serving to secure the sheet of material in a position formed about the flower pot.

The floral sleeves 10–10*e* defined herein may form part of a plant package when used in conjunction with a flower pot disposed therein, or with the flower pot also having a floral grouping disposed therein, and wherein the flower pot is substantially surrounded and encompassed by a lower portion and an upper portion of a sleeve, such as shown in FIG. 3 wherein the flower pot 41 is substantially surrounded and encompassed by the lower portion 30 of the upper portion 40 of the sleeve 10. Preferably, the bottom 41*a* of the flower pot 41 is completely covered by the lower portion 30 of the sleeve 10.

The sleeves 10–10*e* may also be equipped with a drainage element (e.g., one or more holes) in the lower portion thereof or ventilation holes (not shown) or can be made from permeable or impermeable materials.

Preferably the sleeves 10–10*e* are sized to contain and conform to one of a variety of standard sizes of flower pots known to those of ordinary skill in the art, such as 3-inch, 4-inch, 4½-inch, 5-inch, 6-inch, and 8-inch flower pots. In fact, the floral sleeves 10–10*e* may be used to contain a floral grouping and a growing medium without the use of a flower pot 41 for cultivating a floral grouping or displaying a grown floral grouping.

The upper ends 16–16*e* of the sleeves 10–10*e*, respectively, contemplated herein may have a variety of patterns, including straight and non-linear. When non-linear, the upper end 16–16*e* may be wavy, sinusoidal, scalloped, crenulate, crenelate, zig-zagged, or toothed, in any regular or irregular pattern as shown in U.S. Pat. No. 5,493,809 (FIGS. 26–31), the specification of which is hereby expressly incorporated herein in its entirety.

The term "floral grouping," as used herein, means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping may comprise a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement". The term "floral grouping" may also be used interchangeably herein with the terms "botanical item" and/or "propagule."

The term "growing medium," when used herein, means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item," when used herein, means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule," when used herein, means any structure capable of being propagated or acting as an agent of reproduction including seeds, shoots, stems, runners, tubers, plants, leaves, roots or spores.

The term "bonding material," when used herein, means an adhesive, frequently a pressure sensitive adhesive, or a cohesive. When the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer or hot melt material which may be applied to the material and, in this instance, heat, sound waves, or vibrations, also must be applied to effect the sealing.

It will be understood by a person of ordinary skill in the art that equipment and devices for forming floral sleeves such as those contemplated herein are commercially available, and are well known to a person of ordinary skill in the art. For example, the sleeves described herein may be formed by advancing two separate webs, one or two webs preformed in the form of a tube, or a single web folded double and sealing the longitudinal sides and bottom of the two facing panels then cutting the sleeve thus formed from the webs or web. Machines which can form sleeves from such single webs or pairs of webs are well within the knowledge of one of ordinary skill in the art.

The term "flower pot" is used interchangeably with the term "floral container" and as used herein, refers to any type of container used for holding a floral grouping or plant. Examples of flower pots, used in accordance with the present invention include, but not by way of limitation, clay pots, wooden pots, plastic pots, pots made from natural and/or synthetic fibers, or any combination thereof. The flower pot is adapted to receive a floral grouping in the retaining space. The floral grouping may be disposed within the flower pot along with a suitable growing medium as described herein, or other retaining medium, such as a floral foam. It will also be understood that the floral grouping, and any appropriate growing medium or other retaining medium, may be disposed in the floral sleeves 10–10*e* without a pot.

Changes may be made in the construction and the operation of the various components, elements and assemblies described herein or in the steps or the sequence of steps of the methods described herein without departing from the spirit and scope of the invention as defined in the following claims.

What is claimed is:

1. A cover for a floral container, comprising:

a tubular sleeve initially constructed in a substantially flattened state and having an upper end, a lower end, a lower portion and an upper portion extending from the lower portion to the upper end of the tubular sleeve and openable from the flattened state, at least a portion of the lower portion of the tubular sleeve being constructed of an elastic material so that at least a portion of the lower portion of the tubular sleeve can be stretched when a floral container having an upper end, a shape, and a bottom is disposed within the tubular sleeve wherein the lower portion stretches and thereby substantially conforms to the bottom of the floral container and wherein the elastic material which comprises the lower portion is a different material than the material from which the upper portion of the tubular sleeve is constructed.

2. The cover of claim 1 wherein the lower portion further comprises a gusset.

3. The cover of claim 1 wherein the tubular sleeve is provided with a tapered shape.

4. The cover of claim 1 wherein the lower portion of the tubular sleeve is sized to completely cover the bottom of the floral container.

5. The cover of claim 1 wherein the elastic material is a natural or synthetic rubber or a rubberized material.

6. The cover of claim 1 wherein the elastic material is an elastic polyurethane.

7. The cover of claim 1 wherein the tubular sleeve further comprises a detachable extension extending from the upper end of the tubular sleeve.

8. The cover of claim 7 wherein the detachable extension is sized to substantially surround and encompass a floral grouping.

9. The cover of claim 1 wherein the lower portion is attached to the upper portion by a seam seal, a fin seal or a butt seal.

10. A method of covering a floral container, comprising:

providing a tubular sleeve initially constructed in a substantially flattened state and having an upper end, a lower end, a lower portion and an upper portion extending from the lower portion to the upper end of the tubular sleeve and openable from the flattened state, the lower portion at least partially constructed from an elastic material, the elastic material comprising a different material than the material from which the upper portion of the tubular sleeve is constructed;

to providing a floral container having an upper end, a bottom and a shape; and disposing the floral container into the opened tubular sleeve wherein the lower portion of the tubular sleeve stretches and thereby substantially conforms to the bottom of the floral container.

11. The method of claim 10 wherein in the step of providing a tubular sleeve, the lower portion of the tubular sleeve further comprises a gusset.

12. The method of claim 10 wherein in the step of providing a tubular sleeve, the sleeve further comprises a tapered shape.

13. The method of claim 10 wherein in the step of providing a tubular sleeve, the lower portion of the tubular sleeve is sized to completely cover the bottom of the floral container.

14. The method of claim 10 wherein in the step of providing a tubular sleeve, the elastic material is a natural or synthetic rubber or a rubberized material.

15. The method of claim 10 wherein in the step of providing a tubular sleeve, the elastic material is an elastic polyurethane.

16. The method of claim 10 wherein in the step of providing a tubular sleeve, the tubular sleeve further comprises a detachable extension.

17. The method of claim 16 wherein in the step of providing a tubular sleeve, the detachable extension is sized to substantially surround and encompass a floral grouping.

18. The method of claim 10 wherein in the step of providing a tubular sleeve, the lower portion is attached to the upper portion by a seam seal, a fin seal or a butt seal.

* * * * *